United States Patent [19]

Whiley

[11] 4,000,834

[45] Jan. 4, 1977

[54] APPARATUS FOR HEATING AND DISPENSING FLOWABLE MATERIAL

[75] Inventor: Edmond R. Whitley, Knoxville, Tenn.

[73] Assignee: General Electric Company, Bridgeport, Conn.

[22] Filed: Dec. 17, 1975

[21] Appl. No.: 641,675

[52] U.S. Cl. ..... 222/180

[51] Int. Cl.[2] ..... B65D 83/14

[58] Field of Search ... 222/182, 183, 180, 146 HA; 219/214

[56] References Cited

UNITED STATES PATENTS

| | | | |
|---|---|---|---|
| 3,269,600 | 8/1966 | Webber | 222/180 X |
| 3,269,602 | 8/1966 | Weber | 222/180 X |
| 3,749,880 | 7/1973 | Meeks | 222/146 HA X |

*Primary Examiner*—Stanley H. Tollberg
*Attorney, Agent, or Firm*—John F. Cullen; George R. Powers; Leonard J. Platt

[57] ABSTRACT

In an apparatus for electrically heating flowable material from a pressurized container and having a housing supporting the container, and a heat exchanger connected to receive material from the container and dispense it through a valve actuator assembly and having heating structure to control the temperature of the dispensed material, an improvement is provided in the support and valve actuator assembly structure that comprises a single integral flexible plastic claw-like member supported in the housing with a first set of spaced projections depending through the housing and fixedly locking the member on the housing. A second set of spaced projections depends through the housing to lockingly engage and support a container. A tubular passage in the member telescopically receives the container outlet through one end and receives an actuator stem in the other end of the passage that telescopically moves against the container outlet to dispense material. The integral member also has a side passage between the stem and outlet and it is connected to the heat exchanger. Thus, a single fixed member functions as a container fixed sole support and valve actuator assembly for selectively dispensing controlled, heated and measured material.

6 Claims, 6 Drawing Figures

FIG. 3.

APPARATUS FOR HEATING AND DISPENSING FLOWABLE MATERIAL

BACKGROUND OF THE INVENTION

1. Field of the Invention

This invention relates to apparatus for heating flowable material dispensed from pressurized containers and, more particularly, to an improved single integral valve actuator assembly that supports the container, and controls and dispenses measured material such as shave cream therefrom.

2. Description of the Prior Art

Apparatus for heating shave cream dispensed from pressurized aerosol containers is known and the containers use a propellant gas to discharge their foam products. The gas is dispensed under pressure and in liquified form in the container and, upon opening of the container discharge valve forces the product out of the container and simultaneously expands forming gas bubbles and generating foam as is well known in aerosol shaving cream cans.

Expansion has a cooling effect on the foam — undesirable in shaving creams because it is uncomfortable and slow in softening the beard which is more easily shaved when softened by moisture and the softening is generally proportional to the cream temperature. Various heating devices are available for heating foam shave cream as it is dispensed to increase the ease and effectiveness of shaving.

Since the gas bubbles in the foam act as heat insulators the cream is difficult to heat. Also, it has a high viscosity and, if unduly constricted so that it absorbs heat quicker, it may not flow at a useful rate.

Some prior art devices provide a reservoir for hot tap water to heat the shave cream, and others use electric heating means, a typical one being shown in U.S. Pat. No. 3,749,880 of common assignment. Such a device handles many shaving creams as opposed to some devices that handle only one or a few selected cans. It has a valve assembly tube connected to a heat exchanger. The valve assembly moves up and down causing a flexing of the connecting tube causing wear. A co-pending application of common assignment Ser. No. 641,674 filed concurrently discloses an improvement on the dispenser of said patent by improving on the support and valve actuator assembly construction and the present invention is a detailed container support and valving structure in the general combination of said co-pending application.

SUMMARY OF THE INVENTION

Briefly described, the present invention is directed to an apparatus for electrically heating flowable material from a pressurized container supported in a housing and having a heat exchanger connected thereto to receive material dispensed through a valve actuator assembly with means to control the temperature of the dispensed material all as disclosed in said co-pending application Ser. No. 641,674. In this general arrangement, the invention provides an improvement in the specific support and valve actuator assembly means comprising a claw-like member supported in the housing with a first set of spaced projections depending through an upper wall of the housing and fixedly locking the member into the housing. A second set of spaced projections depends through the housing upper wall to lockingly engage and support a container thereon in a suspended manner. A vertical tubular passage in the fixed member receives a container outlet through one end and an actuator stem in the other end to be axially pressed against the container outlet to dispense material. A side passage in the member is connected to the heat exchanger whereby a controlled single integral fixed member acts as the sole support of the container and as a completely fixed valve actuator assembly thus reducing wear on the dispensing mechanism and accommodating a variety of cans of foam. Thus, the main object of the invention is to provide an improved structurally detailed single and integral valve actuator assembly that is fixed in the housing for no movement; handles substantially all size cans; acts as the sole support of the container; and allows for selectively dispensing controlled, heated, and measured material.

DESCRIPTION OF THE PREFERRED EMBODIMENT

The invention is described in connection with shaving cream although it is applicable to any flowable material.

Figure 1:
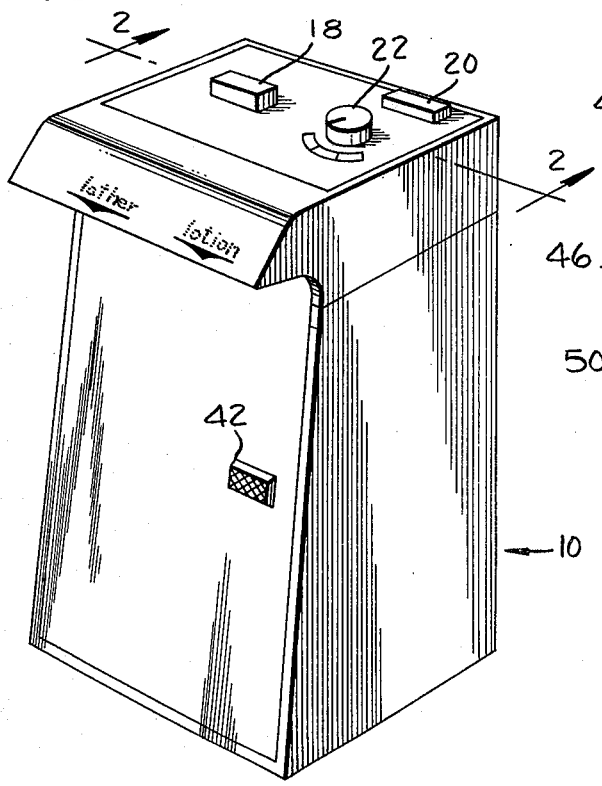
FIG. 1 is a perspective view of the heated shave cream dispenser.
Figure 2:
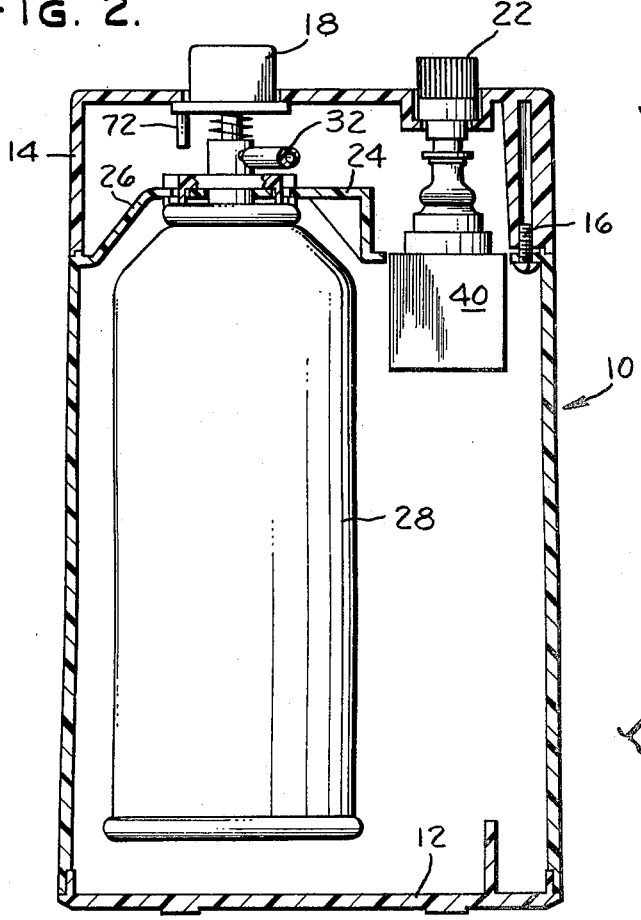
FIG. 2 is a partial cross-sectional view on line 2—2 of FIG. 1.

Referring to FIGS. 1 and 2, there is shown a heated shave cream dispenser having a plastic molded housing 10 and a base 12 readily detachable from the housing for replacement of a pressurized container. A cover 14 is semi-permanently attached to the housing from below by screw fasteners 16 to enclose the working parts and provide a base for various indicia and controls such as lather dispenser button 18, lotion button 20, and thermostat 22, to effect temperature control of the lather. Cover 14 is preferably designed to overhang the front portion of housing 10 so the user's hand fits in the overhang to receive heated lather or shaving lotion as indicated in FIG. 1. To support the pressurized container and operating components of the apparatus, the housing has an upper wall 24 that may be molded as part of the housing and formed with a cone-like depression 26 to assist in locating and centering a large number of leading brands of foam lather dispenser aerosol type containers 28.

Figure 6:
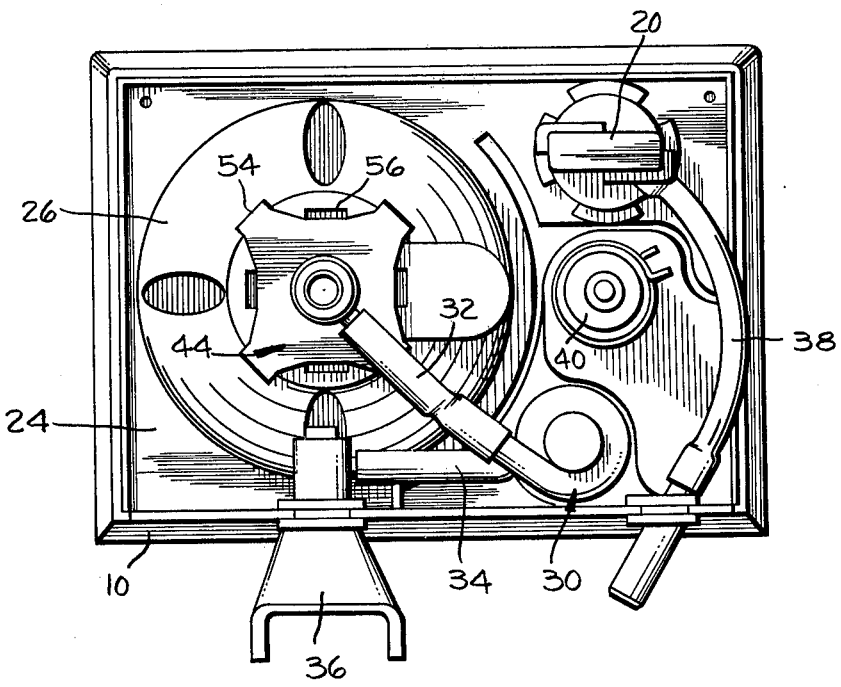
FIG. 6 is a top plan view, with the cover removed.

Referring to FIG. 6, the rest of the internal operating structure is generally shown, all being supported on upper wall 24, consisting of a heat exchanger assembly 30 of a tube wrapped around a central heated post and selectively receiving material dispensed from the container through fixed connecting tube 32, the assembly heating and directing it out a second tube 34 and thence out dispenser nozzle 36 under "lather" as indicated on the overhang of cover 14 in FIG. 1. Similarly, a suitable lotion, not shown, may be stored in the housing and pumped by suitable button 20 to be discharged through connecting tube 38 under "lotion" in the overhang of the cover 14 as indicated. The apparatus is designed to automatically heat shaving cream including gels to a set desired temperature as set by single thermostat button 22, which, upon depression, activates the circuit through thermostat 40 much like an off/on volume control in a TV set. Included in the circuit is suitable indicator light 42 that may light when the circuit is "on" and goes out when the set temperature is reached.

The various heating, thermostat control, and lotion dispensing structure form no part of the present invention except as they fit in the overall package of FIG. 1 with the heat exchanger 30 remote from the container 28 — a desirable feature to avoid heating the aerosol container.

The improvement in said co-pending application is directed to a combination to simplify the support and valve actuator assembly means to support container 28 and operate the dispensing mechanism with substantially all different size containers while avoiding any axial or flexural movement whatever of the valve structure and connecting tube 32. The present invention is directed to a detailed container support with the valve actuator structure in the general combination of said copending application. Eliminating normal axial motion avoids wear on the connecting tube 32 due to constant flexing as lather is dispensed. Thus, it is desired that the mechanism be firmly fixed in the housing and the only motion be that of depressing the container outlet in the normal manner of any aerosol container.

Figure 3:
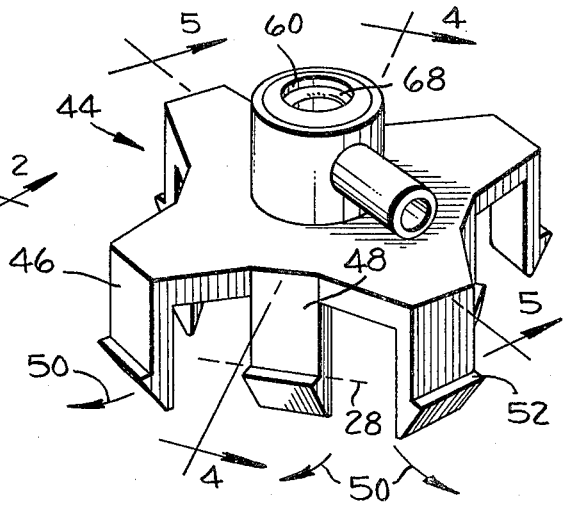
FIG. 3 is a perspective view of the main valve member.

To this end, there is provided a preferably flexible plastic single integral claw-like member generally indicated as 44 in FIG. 3. This single molded member acts as a detailed sole support of the container, and with actuator button 18 it also acts as a valve actuator assembly accepting most containers. Thus, the particular single member performs several functions with no movement itself to wear by flexing parts.

Referring to FIG. 3, member 44 is formed with two sets of angularly spaced depending projections, with an outer or first set 46 and an inner second set 48 in a general claw-like shape as clearly shown in FIG. 3. The entire member 44 is a single molded integral plastic such as an ABS or equivalent which is easily formed by molding into the desired shape. As shown in FIG. 3, the sets of several projections are preferably alternately disposed in concentric loops, with the outer loop being formed by projections 46 and the inner loop being formed by projections 48. The concentricity provides a radial space between the loops wherein the container 28 is supported as indicated by the dash line 28 in FIG. 3. For purposes that will become apparent, it is desirable that the flexible projections be biased away from the vertical centerline of member 44 in the direction of arrows 50 as shown on FIG. 3. Additionally, each of the projections is provided with an outwardly extending barb 52 which fixedly locks the engaged housing and/or container means against vertical movement as will become apparent.

Figure 4:
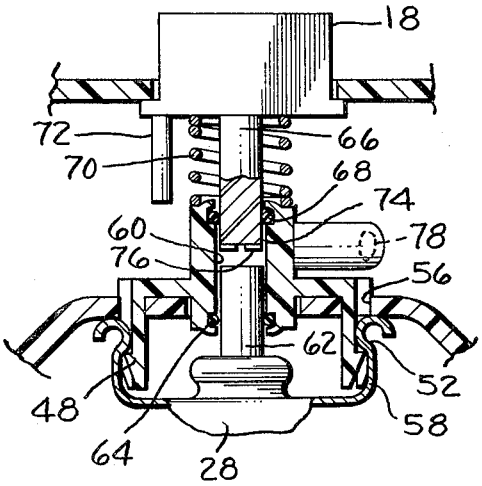
FIG. 4 is a partial cross-sectional view on line 4—4 of FIG. 3 including the actuator and container.
Figure 5:
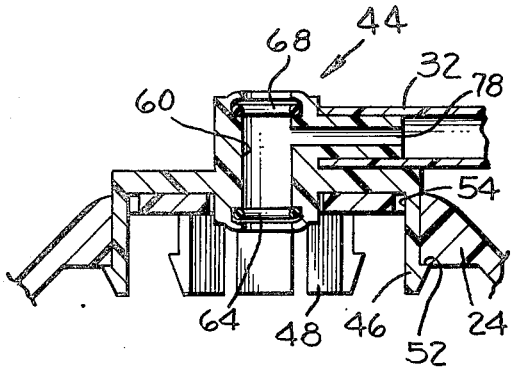
FIG. 5 is a similar view on line 5—5 of FIG. 3 with the connecting tube shown for clarity.

In order to better fixedly support container means 28 in the housing without separate fasteners this invention uses concentric claws with the outer or first set of projections 46 depending through suitable spaced receiving slots 54 in upper wall 24. The outward bias of the projections away from the vertical centerline causes each barb 52 to overhang the housing interior and fixedly lock member 44 securely to housing wall 24, as seen in FIG. 5. Then, in the same manner, the second set of spaced projections 48 with their barbs 52 depend through suitable receiving slots 56 in housing wall 24 to lockingly engage under the customary rolled flange 58 of the pressurized container to form the sole support of the container on the housing as seen in FIG. 4. While containers are generally standardized, the flexibility of all the projections such as projections 48, allow for some variation in the rolled flange 58 diameter to accommodate most brands of pressurized containers. Thus, member 44 is securely and fixedly locked into upper wall 24 with no axial relative movement possible and the member then forms the sole support for numerous containers 28 as seen in FIG. 2. Additionally, this same structure forms the main part of the dispensing valve actuator assembly for many differing valved containers as disclosed in said co-pending application and now explained.

In order to selectively pass the measured dispensed material from the container 28 for heating, member 44 is formed with a vertical tubular passage 60 extending therethrough as shown in FIGS. 3–5. As best shown in FIG. 4, the passage 60 fixedly receives container outlet 62 through one end of the passage and is sealed thereto by a suitable O-ring 64. In the same manner, an actuator stem 66 extends from button 18 down into the top other end of the passage and is sealed by O-ring 68 and is also guided for sliding axial movement against container outlet 62 to release and dispense foam between the sealed points as is well known. Thus, the fixed passage 60 of the valve assembly telescopically receives outlet 62 and stem 66 to universally accommodate substantially all lengths of outlets 62 on many differing valved containers. Spring 70 biases button 18 into the upper position and a suitable stop 72 limits the depressed position of the actuator. In order for foam to pass around the actuator it is spacedly disposed to define an annulus 74 which, with grooves or extensions 76 on the bottom of stem 66, allows the foam material to be dispensed into side passage 78 located substantially between the sealed points of stem 66 and container outlet 62 as shown in FIGS. 4 and 5. The selectively dispensed foam passes through side passage 78 between the sealed points and then through heat exchanger 30 (FIG. 6) for heating and subsequent selective dispensing through nozzle 36.

It will be seen that member 44 is a single integrally molded flexible plastic member and, with its double claw structure is fixedly disposed in top wall 24 without external fasteners and locked against any axial movement whatever by its depending outer set of flexible projections 46. It acts as the sole support of pressurized container 28 by inner flexible projections 48 and adapts to a large variety of aerosol containers. With side passage 78 thus stationary at all times while connecting to the heat exchanger, there is no flexing of parts and no motion except that of selective telescopic actuation of stem 66 in passage 10 which, in turn accommodates differing valve stem lengths of many containers. Thus, there is no wearing of parts due to flexing of any of the connecting members resulting in longer life. Further, container 28 is rapidly and easily snapped in and out of position through the bottom of housing 10 and is well removed from the heat exchanger structure. The device is compact and aesthetically pleasing being very little higher than the container it is designed to hold. Finally, the several parts of prior construction have been replaced by the single double claw member 44 that functions as a sole container support and valve assembly to selectively dispense controlled measured amounts of heated material from many sized containers, and greatly simplifies the construction at lower cost.

While there has been described a preferred form of the invention, some equivalent variations are possible in light of the above teachings. It is therefore to be understood that, within the scope of the appended claims, the invention may be practiced otherwise than as specifically described, and the claims are intended to cover such equivalent variations.

I claim:

1. In an apparatus for electrically heating and dispensing flowable material from a pressurized container including a housing supporting the container, a heat exchanger connected thereto receiving material dispensed through a valve actuator assembly, and means effecting temperature control of said material, the improvement in the support and valve assembly means comprising, said housing having spaced openings, a claw-like member means supported in the housing with a first set of spaced projections depending through said housing opening fixedly locking said member therein, a second set of spaced projections depending through said housing to lockingly engage and support a container means thereon, a tubular passage in said member sealingly and fixedly receiving the container outlet through one end of the passage, an actuator stem sealingly and spacedly disposed in the other end of the passage for movement against the container outlet to release and dispense material, and a side passage in said member substantially between the stem and outlet and connected to said exchanger, whereby said fixed member functions as the container support and valve actuator assembly for selectively dispensing controlled, heated, and measured material.

2. Apparatus as described in claim 1 wherein said sets of projections are alternately disposed in concentric loops radially spaced from each other whereby the container is secured between the loops.

3. Apparatus as described in claim 2 wherein said claw-like member is a flexible molded plastic with integral projections, all said projections being biased outwardly from the axial centerline of said member.

4. Apparatus as described in claim 1 wherein said member functions as the sole support for said container and said tubular passage means is vertically disposed in said member with the actuator slidingly movable therein against the container outlet.

5. Apparatus as described in claim 1 wherein spaced slots are disposed in the housing receiving said projections and said projections have a barb thereon, the projections being flexible and biased away from the vertical centerline of said member, whereby the barbs fixedly lock their engaged means against vertical movement.

6. Apparatus as described in claim 5 wherein said member functions as the sole support for said container and said tubular passage means is vertically disposed in said member with the actuator slidingly movable therein against the container outlet.

* * * * *